US007262354B2

(12) United States Patent
Orred et al.

(10) Patent No.: US 7,262,354 B2
(45) Date of Patent: Aug. 28, 2007

(54) STRINGED PRACTICE DEVICE AND METHOD

(76) Inventors: Gregory D. Orred, 7 Granby Frams Rd., Granby, CT (US) 06035; James S. Bell, 19 Coppermill Rd., Wethersfield, CT (US) 06109

( * ) Notice: Subject to any disclaimer, the term of this patent is extended or adjusted under 35 U.S.C. 154(b) by 28 days.

(21) Appl. No.: 11/072,702

(22) Filed: Mar. 4, 2005

(65) Prior Publication Data

US 2006/0196338 A1 Sep. 7, 2006

(51) Int. Cl.
*G10D 3/00* (2006.01)

(52) U.S. Cl. ..... 84/293

(58) Field of Classification Search ..... 84/290, 84/293, 267

See application file for complete search history.

(56) References Cited

U.S. PATENT DOCUMENTS

| | | | | |
|---|---|---|---|---|
| 826,379 | A | 7/1906 | Sprotte | |
| 1,751,048 | A | 3/1930 | Miessner | |
| 1,839,244 | A | 1/1932 | Meisel | |
| 3,218,904 | A | 11/1965 | Hartman | |
| 3,403,590 | A | 10/1968 | Quinton | |
| 4,031,801 | A | 6/1977 | Cecchini | |
| 4,065,995 | A | 1/1978 | Greer | |
| 4,112,804 | A | 9/1978 | Cecchini | |
| 4,364,298 | A * | 12/1982 | Piazza | 84/465 |
| D284,203 | S | 6/1986 | Landau | |
| 5,537,906 | A * | 7/1996 | Steinberger | 84/291 |
| 5,756,914 | A * | 5/1998 | Streibl | 84/465 |
| 5,811,704 | A | 9/1998 | Anderko | |
| D403,012 | S | 12/1998 | Anderko | |
| 6,127,615 | A * | 10/2000 | Rosenberg | 84/465 |
| 6,452,077 | B1 | 9/2002 | Chapman | |

OTHER PUBLICATIONS

Willis Whiteside, "Little Fretty", Description of guitar warm-up excerciser, www.fretocizer.com/about.htm, 4 pages, Mar. 4, 2005.

* cited by examiner

*Primary Examiner*—Kimberly Lockett
(74) *Attorney, Agent, or Firm*—Michael A. Blake

(57) ABSTRACT

The disclosed apparatus relates to a stringed practice device comprising: a neck with an upper end and a lower end; a headstock coupled to the lower end of the neck; and where the headstock comprises a plurality of tuning posts. The disclosed method relates to a using a stringed practice device. The method comprises resting a headstock against a thigh of the user; and fingering the strings on a neck of the stringed practice device with one hand of the user.

15 Claims, 10 Drawing Sheets

STRINGED PRACTICE DEVICE AND METHOD

TECHNICAL FIELD

The present invention relates generally to stringed musical instruments. More particularly, this invention relates to a device that enables one to warm up and to practice one's guitar fingering skills, as well as build the calluses and or muscles necessary for guitar playing.

BACKGROUND

Conventional acoustic guitars typically have a hollow, resonant body with a round sound hole, a fretted neck projected longitudinally from one end of the body, and six or twelve strings running from the end, or top, of the neck to the opposite end of the body. The strings are fastened at the top of the neck with tuning machines, and to the body with a bridge mounted to the surface of the body, referred to as a sound board. In this manner, the strings span the sound hole, such that plucking the strings with one hand produces a resonant sound within the body cavity, while the player's other hand is used to stop the strings at the appropriate frets to produce the desired pitch for each string played. The same playing technique is entailed with an electric guitar, though these guitars differ from acoustic guitars by having a solid body with an electric pickup instead of a sound hole.

For one to excel at playing a guitar, mastery of two separate skills—plucking (also known as picking) the strings and fingering the neck—is necessary. However, each of these skills may require concentrated and independent practice directed specifically toward the particular skill. Accordingly, it would be desirable to have a device available that enabled a musician or music student to practice the skill of fingering the neck. Additionally, it would also be desirable if a device were available to allow a musician to warm up his hand in anticipation of actual guitar playing.

A disadvantage with practicing on a stringed instrument or a prior art practice device, is that they can be cumbersome, unportable, and relatively large to use in a small space. Another disadvantage is that some practice devices are made out of an inexpensive plastic material, which may feel toy-like to the user. Some practice devices do not have strings, they are used to practice finger placement without strings, thus they do not allow for the development and maintaining of calluses on the fingers of guitar players.

Accordingly there is a need for a stringed practice device that overcomes these and other disadvantages.

SUMMARY

The disclosed apparatus relates to a stringed practice device comprising: a neck with an upper end and a lower end; a headstock coupled to the lower end of the neck; and where the headstock comprises a plurality of tuning posts.

The disclosed method relates to a using a stringed practice device. The method comprises resting a headstock against a thigh of the user; and fingering the strings on a neck of the stringed practice device with one hand of the user.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
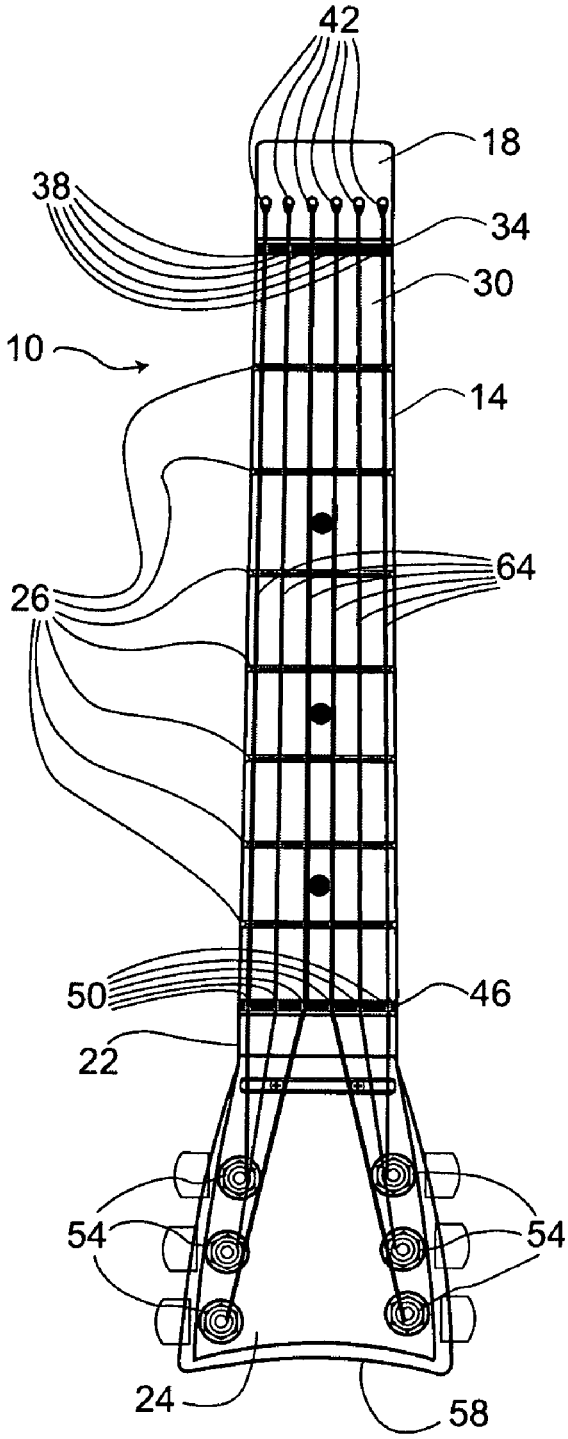
FIG. 1 is front view of a seven fret electric guitar embodiment of the stringed practice device.

FIG. 1 is a front view of one embodiment of the stringed practice device 10. The stringed practice device 10 comprises a neck 14, with an upper end 18 and a lower end 22. On a normal stringed instrument, there is usually a headstock located at the upper end 18 of the neck 10. However, in this disclosed apparatus, the stringed practice device 10 has a headstock 24 located at the lower end 22 of the neck 10. In the disclosed embodiment, the headstock 24 acts as both a headstock and a body of the stringed practice device. The device has a plurality of frets 26 located on a fretboard 30 located on the neck 14. On the upper end of the neck 10, an upper nut 34 is attached. The upper nut 34 has a plurality of channels 38 that are aligned with a plurality of slots 42 that pass through the upper end 18 of the neck. The device 10 has a lower nut 46. The lower nut 46 also has a plurality of grooves 50. Located on the headstock are a plurality of tuning posts 54, also known as tuning machines. Strings 64 may be installed on the device by stringing the non-balled end of a string 64 through the back side of the neck 14 via a slot 42, then along a groove 50 of the upper nut 34. The string 64 runs along the length of the neck 14 to the lower nut 46, where the string run along a groove 50, where it is attached to one of a plurality of tuning posts 54. Other means may be used for attaching the strings 64 to the device 10, including, but not limited to: the strings 64 may be mounted to a bridge or a nut located at the upper end 18. The tuning machines may be configured to operate as they do in typical stringed instruments, that they may allow the player to make adjustments to the string tension to more closely replicate the string tensions on a guitar or other stringed instrument. The headstock 24 and the neck 14 may lie in the same plane, or their may be an angle between the headstock 24 and the neck 14. The angle may increased or decreased depending on the needs of the end user. Additionally, the shape of the headstock 24 may be generally trapezoid, or in other embodiments, may be generally any of the following non-limiting shapes: oval, round, square, parrallogram, square, and rectangular.

The headstock 24 has a lower side 58. The lower side, in one embodiment, is curved. However, in other embodiments, the lower side 58 may be straight, have a sharper curve, or a more flat curve, or may comprise an intermittently curved and intermittently straight surface.

Figure 2:
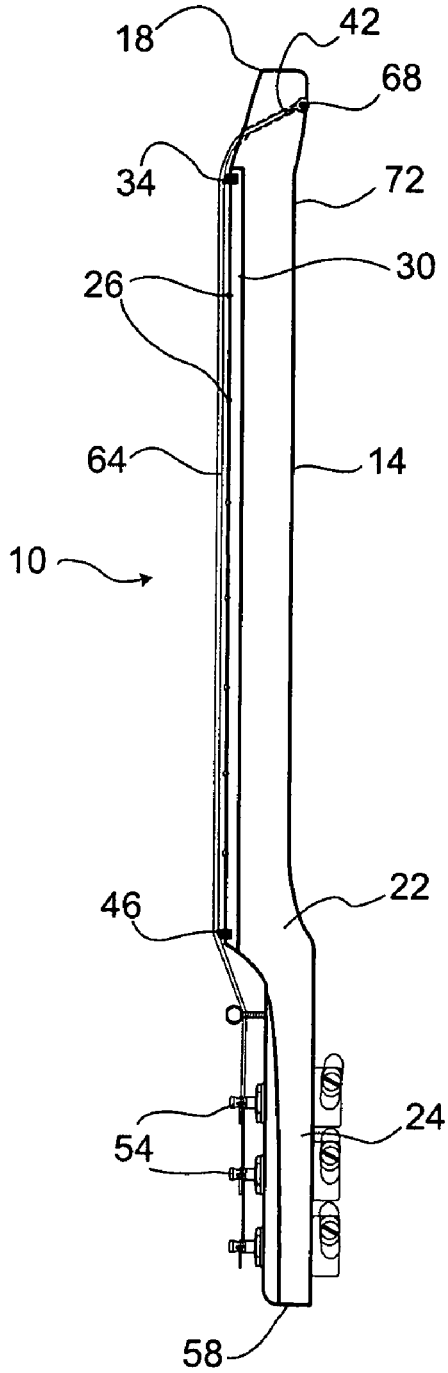
FIG. 2 is a side view of the stringed practice device from FIG. 1.

FIG. 2 shows a side view of the stringed practice device 10. As can be seen in this view, the ball-end 68 of the string 64 remains on the back side 72 of the neck 14. The slot 42 is sized such that the ball-end 68 will not slide through the slot 42.

Figure 3:
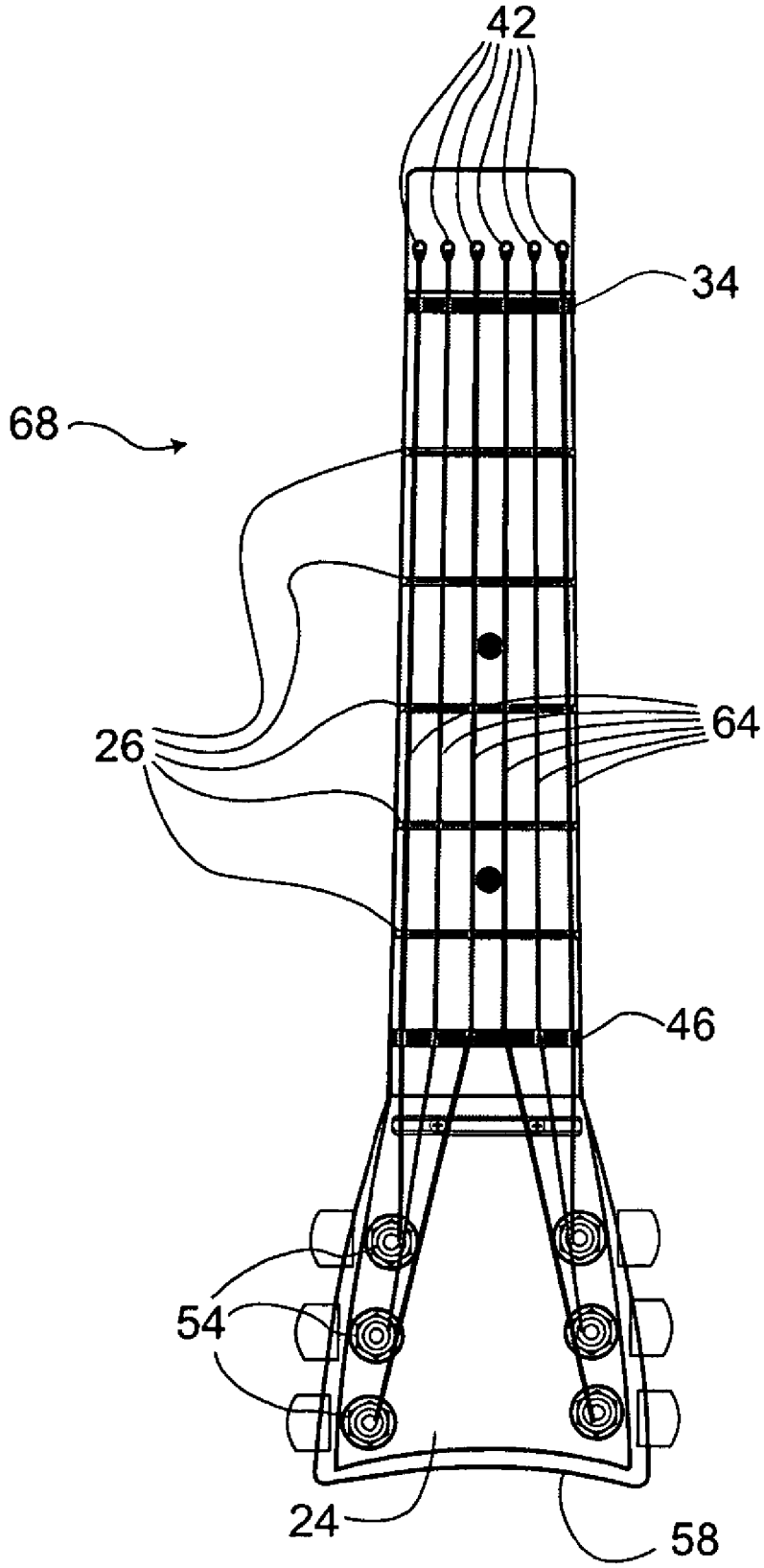
FIG. 3 is front view of a five fret electric guitar embodiment of the stringed practice device.
Figure 4:
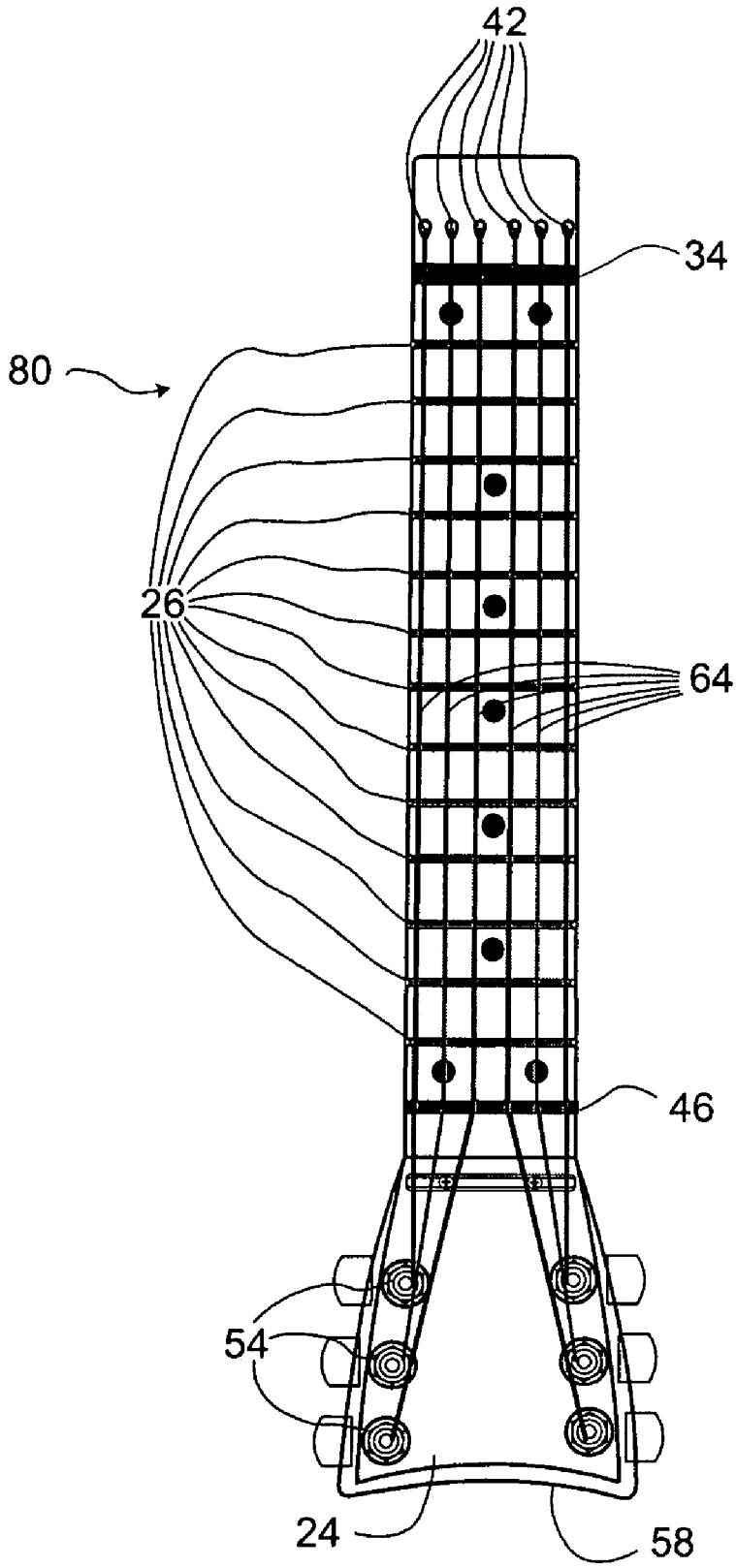
FIG. 4 is front view of a high fret electric guitar embodiment of the stringed practice device.

FIGS. 1 and 2 showed a stringed practice device 10 with seven (7) frets 26. However, the stringed practice device may be made with any number of frets desired. FIG. 3 shows a five (5) fret version of a stringed practice device 68, with five (5) frets 26. FIG. 4 shows a front view of a high fret version of a stringed practice device 80. In this embodiment, the frets 26 approximate the spacing and scale of the frets on a guitar near the bridge-end of the neck.

Figure 5:
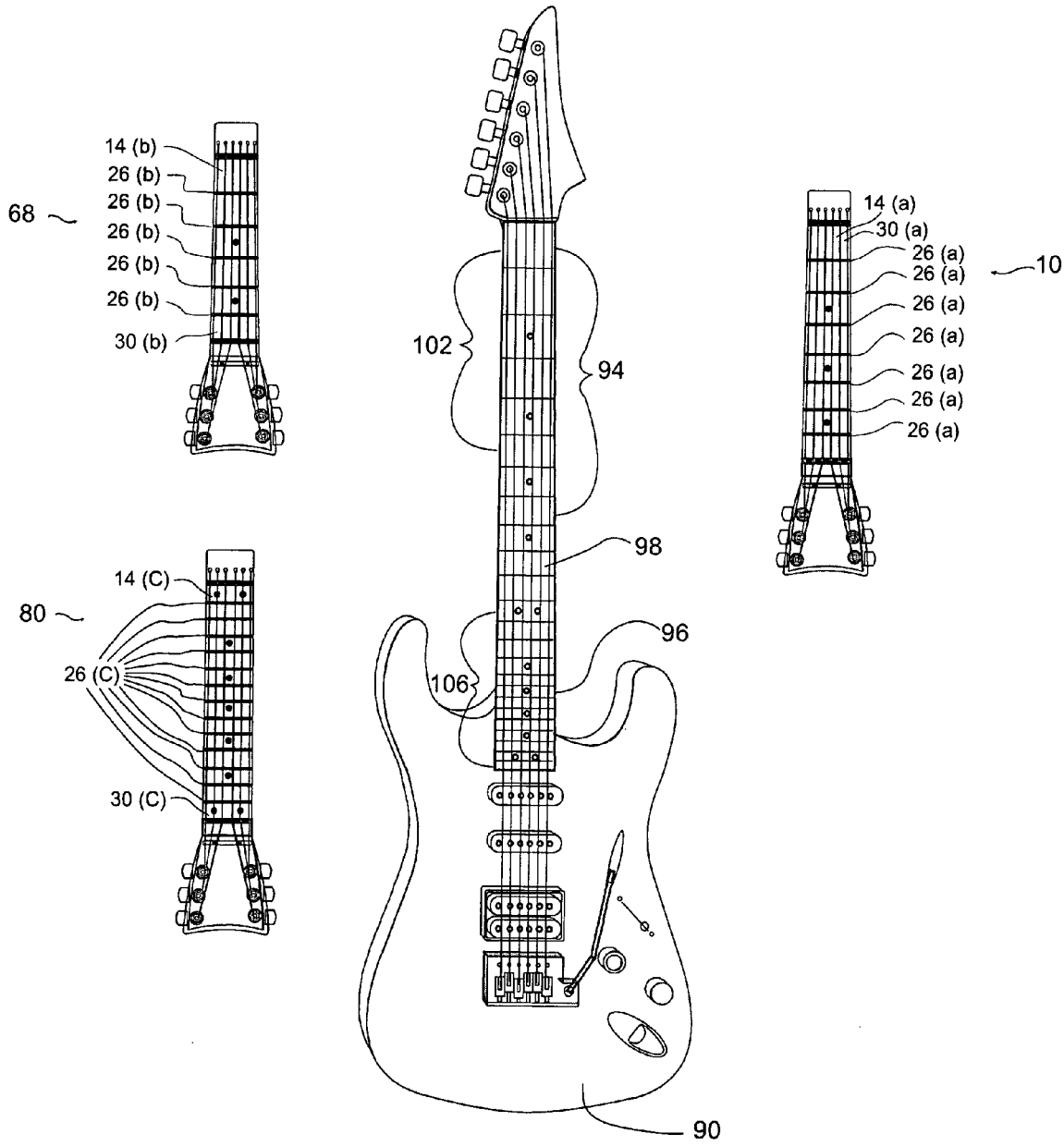
FIG. 5 is a comparative view showing how the five fret, seven fret and high fret stringed practice devices relate to a typical electric guitar.

FIG. 5 shows the three disclosed stringed practice devices 10, 68, 80 and how they relate to a standard electric guitar 90. The seven frets 26(*a*) of the stringed practice device 10 are in approximately the same position, fret placement and scale as the seven frets 94 of the guitar 90. Additionally, the fretboard 30(*a*) radius, size and width of the neck 14(*a*) are approximately the same as the guitar fretboard 98 and guitar neck 96 at a similar relative position with respect to the seven frets 94 of the guitar 90. Similarly, the five frets 26(*b*) of the stringed practice device 68 are in approximately the same position, fret placement and scale as the five frets 102 of the guitar 90. Additionally, the fretboard 30(*b*) radius, size and width of the neck 14(*b*) are approximately the same as the fretboard 98 and neck 96 at a similar relative position with respect to the seven frets 94 of the guitar 90. Also, the plurality of frets 26(*c*), which make up the high fret version of the stringed practice device 80 are in approximately the same position, fret placement and scale as the high frets 106 of the guitar 90. Additionally, the fretboard 30(*c*) radius, size and width of the neck 14(*c*) are approximately the same as the fretboard 98 and neck 96 at a similar relative position with respect to the high frets 106 of the guitar 90. Thus, it should be obvious to one of ordinary skill in the art that the sizing of the neck 14, and spacing and scale of the frets 26 may match that of any various available guitar models.

Figure 6:
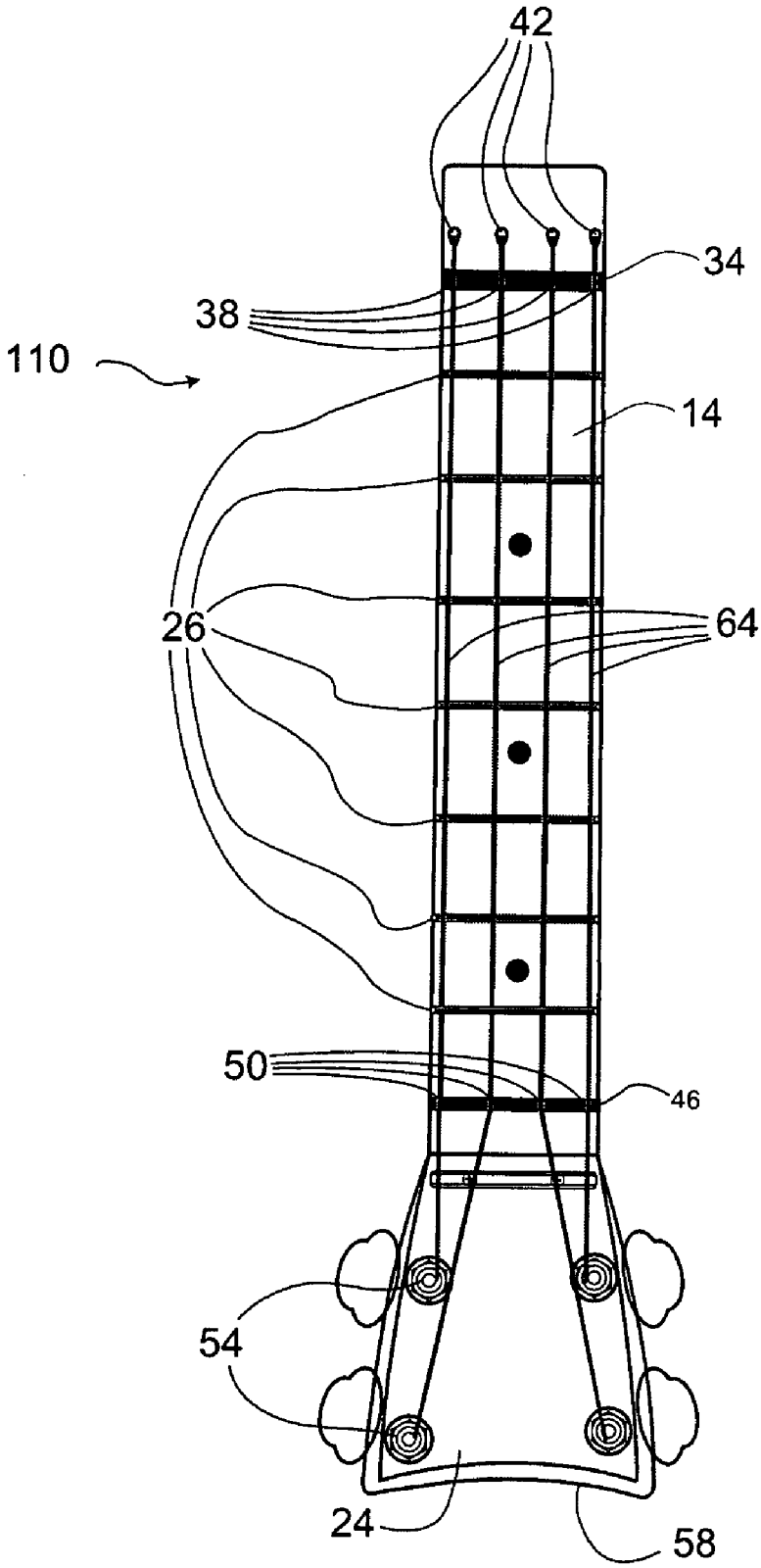
FIG. 6 is a front view of a seven fret electric bass embodiment of the stringed practice device.

FIG. 6 discloses an electric bass stringed practice device 110. The stringed practice device 110 has 4 strings 64, typical of an electric bass. The neck 14 matches the neck of a typical bass, in size and proportion, as well as of the spacing and scale of the frets. The sizing of the neck, and spacing and scale of the frets may match that of various available bass guitar models. Of course, the electric bass stringed practice device 110 may have more or fewer strings 64, as well as more or fewer frets 26, depending on the need of the user.

Figure 7:
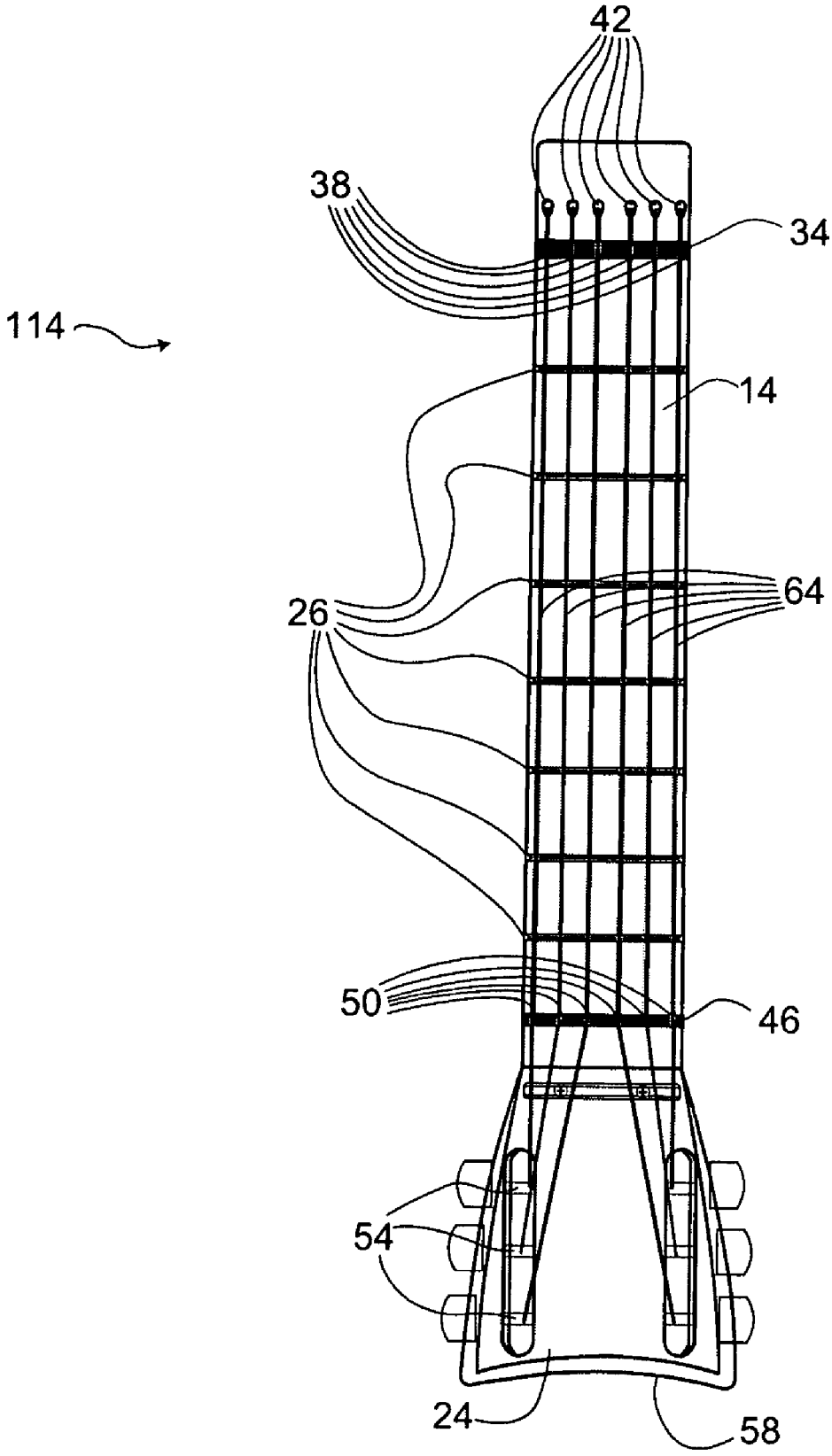
FIG. 7 is front view of a seven fret classical guitar embodiment of the stringed practice device.

FIG. 7 discloses a classical stringed practice device 114. The classical stringed practice device 114 has 6 strings 64, typical of a classical guitar. The neck 14 matches the neck of a typical classical guitar, in size and proportion, as well as spacing and scale of the frets 26. Of course, the classical stringed practice device 114 may have more or fewer strings 64, as well as more of fewer frets 26, depending on the need of the user.

Figure 8:
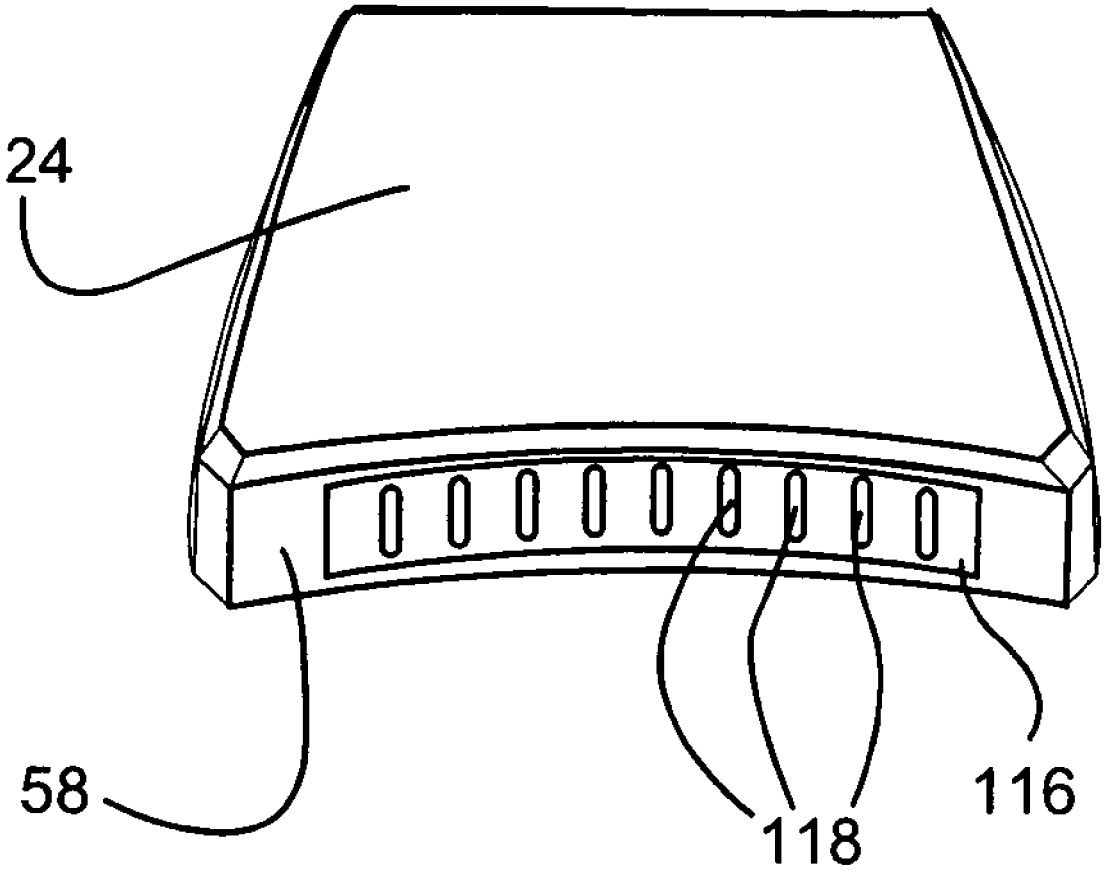
FIG. 8 is a perspective view of a headstock of the stringed practice device.

FIG. 8 shows a perspective view of the headstock 24 without the tuning posts 54. In an embodiment, there may be located on the lower side 58 of the headstock 24 a non-skid device 116. The non-skid devices may comprise, but are not limited to, a plurality of pads 118. The pads may be selected from the group comprising, but not limited to: rubberized pads, plastic pads, abrasive pads, wood pads, and metal pads. In an other embodiment, instead of a plurality of non-skid devices 118, a single non-skid device may be located on the lower side 58 of the headstock 24.

Figure 9:
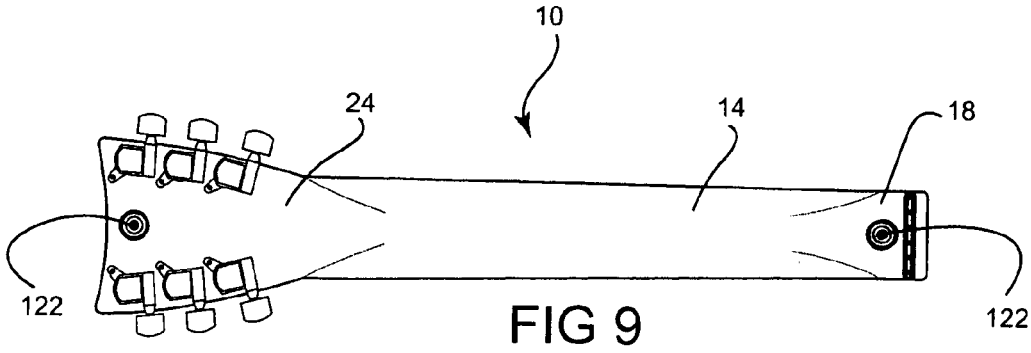
FIG. 9 shows another embodiment of the disclosed stringed practice device.
Figure 10:
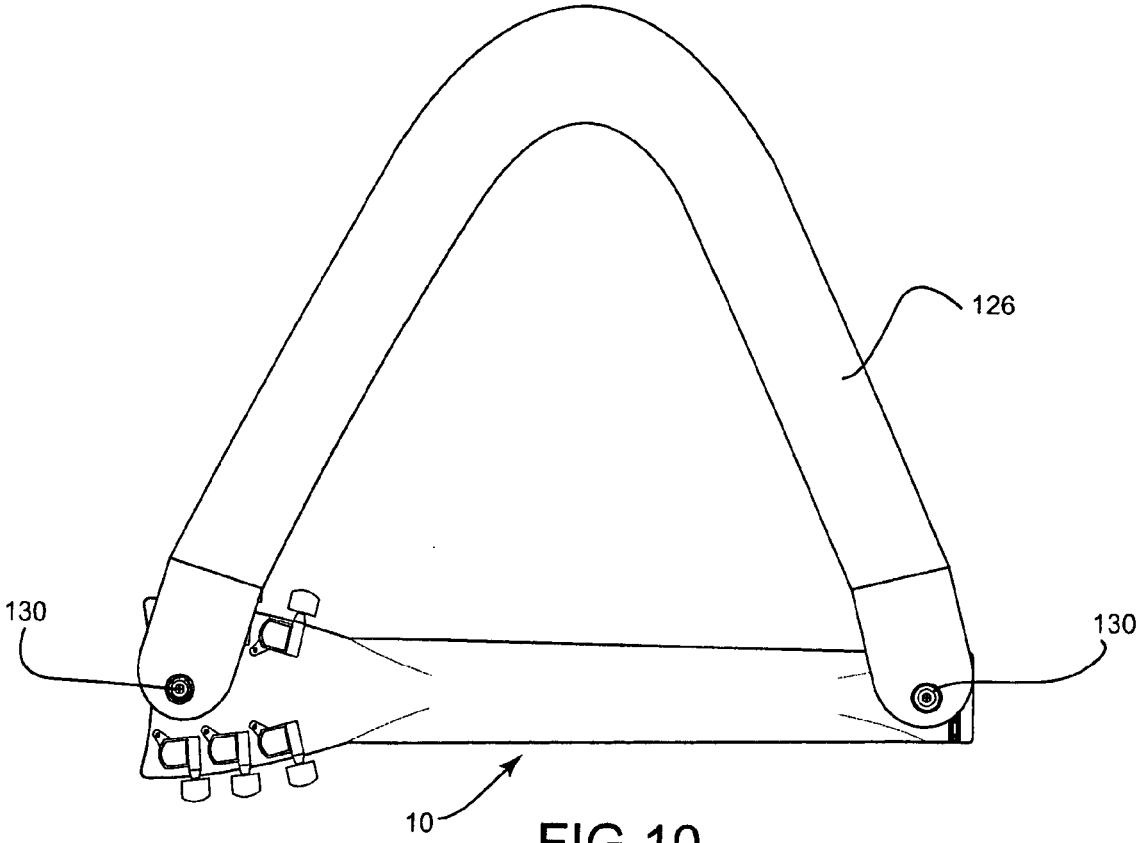
FIG. 10 shows the stringed practice device of FIG. 9 with a guitar strap.
Figure 11:
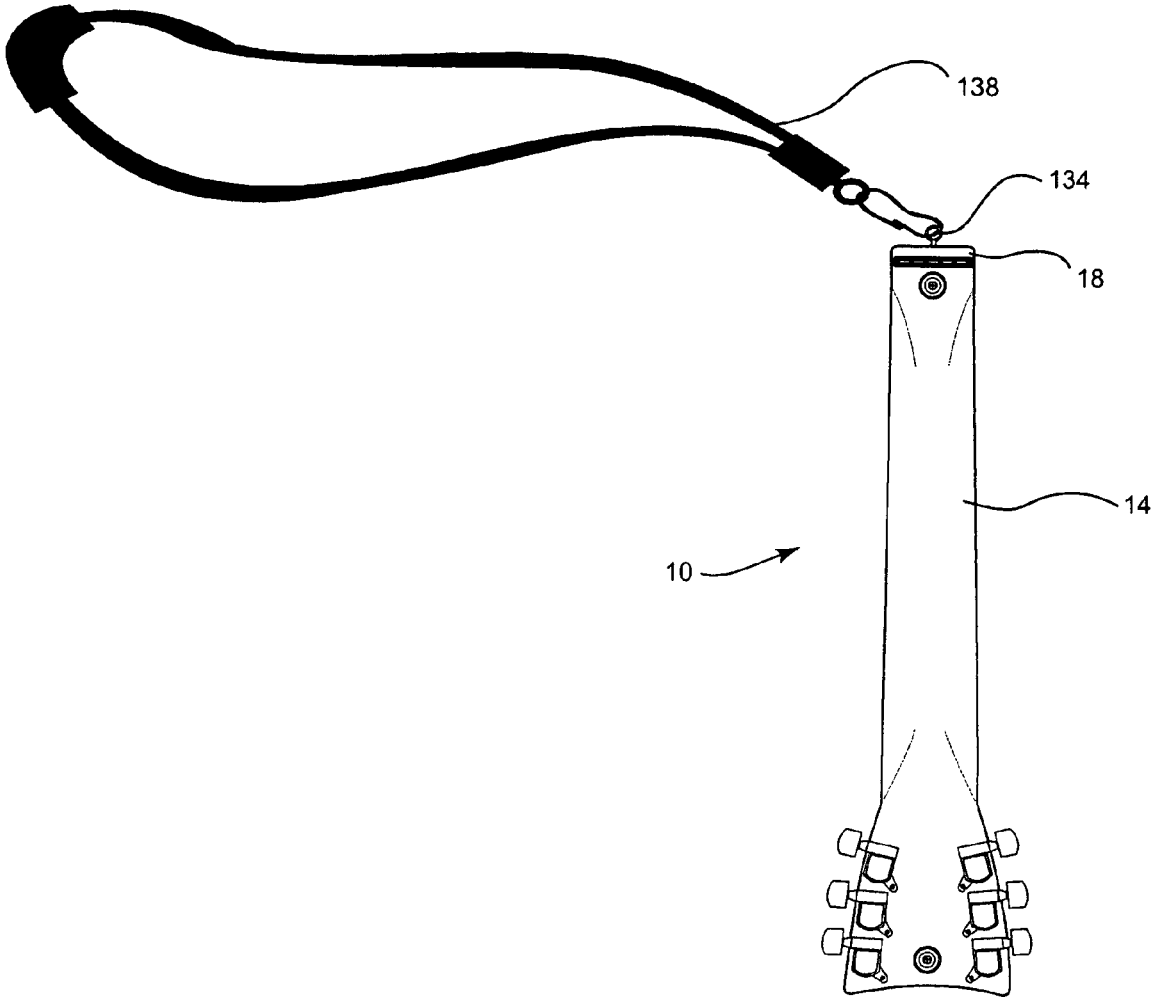
FIG. 11 shows still another embodiment of the disclosed stringed practice device.

FIG. 9 shows another embodiment of the stringed practice device 10. In this embodiment, the device has connectors 122 located at the upper end 18 of the neck 14 and at the headstock 24. As shown in FIG. 10, the connectors are used to removeably attach a guitar strap 126 to the stringed practice device 10 via guitar strap connectors 130. The connectors 22 and strap connectors 130 may be, but are not limited to: snaps and snap receptacles, hooks and rings, buttons and button holes, Velcro surfaces.

In FIG. 10, the stringed practice device 10 may have a lanyard connector 134 located at the upper end 18 of the neck 14. The lanyard connector 134 is removeably attachable to a lanyard 138. The lanyard connector 134 may be, but is not limited to: a ring, a hook, a snap, a snap receptacle, Velcro, button, or button hole. Of course, the stringed practice device may be configured to be removeably attached to both a guitar strap 126 and a lanyard 138 via the connectors 122 and lanyard connector 134.

Figure 12:
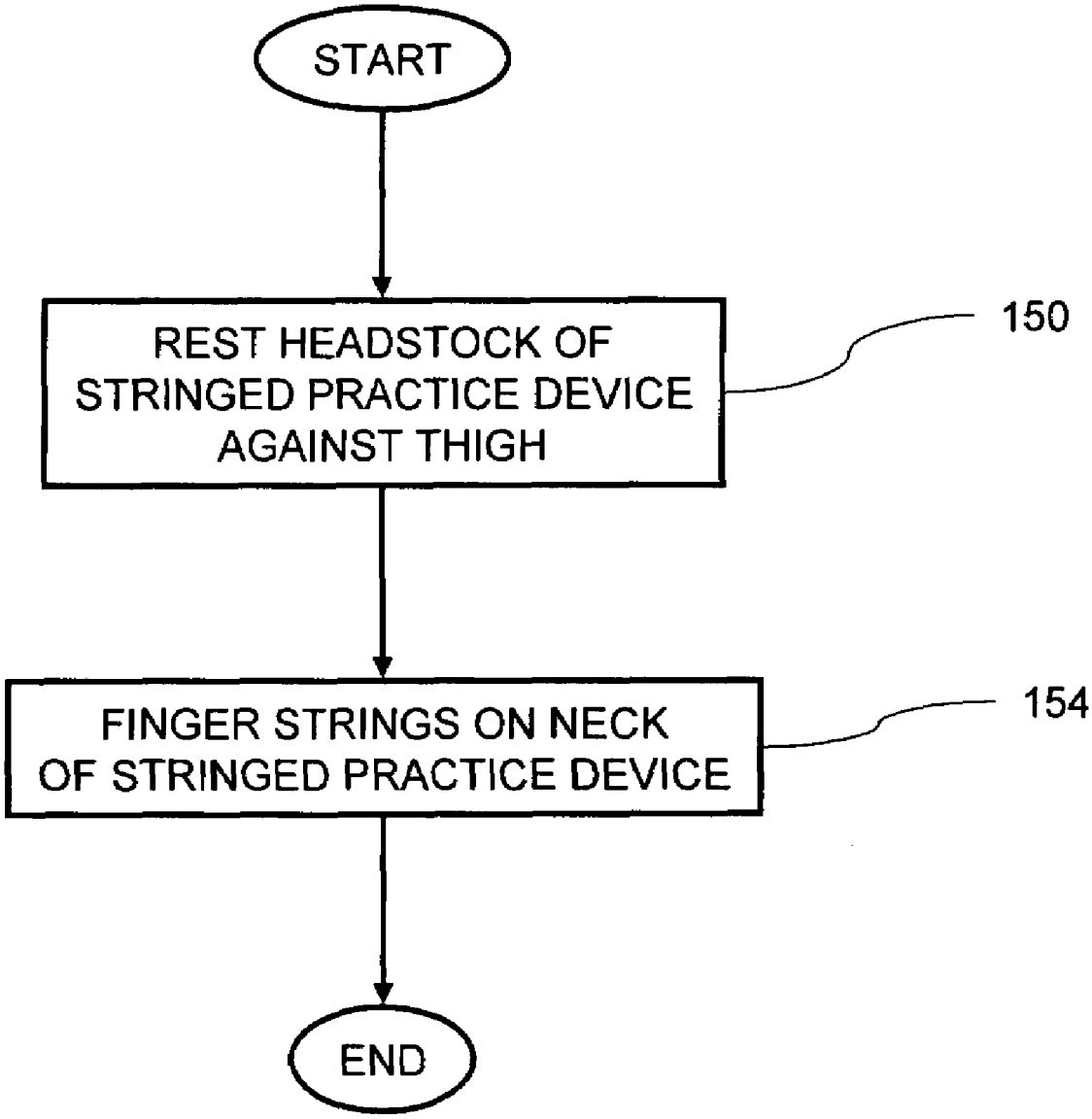
FIG. 12 is a flowchart describing a disclosed method.

A user may warm up or practice his fingering by moving the fingers of his left hand along the strings and frets of the stringed practice device, while resting the lower side 58 of the headstock against his left thigh. Of course, a user may use the stringed practice device with his right hand and rest the headstock against his right thigh. The aforementioned is not meant to limit the way a user may use the stringed practice device, the user may find his own suitable method of practicing or warming up with the stringed practice device. The user may be in a sitting or standing position. The user may use the device while in an automobile, or bus, or airplane, or any other means of transportation. FIG. 12 shows a flowchart that describes one method of using the stringed practice device. At act 150, the user rests the headstock of the stringed practice device against his or her thigh. At act 154 the user fingers the strings on the neck of the stringed practice device. The user may use either his or her left thigh and left hand, or his or her right thigh and right hand.

The disclosed stringed practice device provides for a portable warm up and or practice device for guitar and bass players. The device may approximate the neck size and dimensions and fret spacing of an electric guitar, an electric bass, or a classical guitar. The device may be comfortably placed on the thigh of the user, while the user fingers the strings on the neck of the device. The device may be used while sitting or standing. The device may be used while in an automobile, airplane, bus, train, or any other transportation vehicle. The device has actual strings and frets, to more closely approximate the feel of an actual electric guitar, electric bass, classical guitar, acoustic guitar, acoustic/electric guitar, steel string guitar, or nylon string guitar.

It should also be noted that the terms "first", "second", "third", "upper", and "lower" and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims

What is claimed is:

1. A stringed practice device comprising:

a tapered neck with an upper end and a lower end, wherein the neck is wider at the lower end than it is at the upper end;

a headstock coupled to the lower end of the neck;

a lower side located on the headstock, the lower side having a generally concave curve configured to generally fit and rest on a user's thigh during use;

a plurality of tuning posts located on the headstock; and wherein the stringed practice device is configured such that during use the lower side rests against a thigh of the user and the neck is oriented to be generally above the headstock so that the user can finger the stringed practice device with one hand.

2. The stringed practice device of claim 1, wherein the lower side further comprises an intermittently curved and an intermittently straight surface.

3. The stringed practice device of claim 1, further comprising:

a plurality of slots each of which pass through the upper end of the neck; and wherein each of the slots are configured to hold a ball-end of a string on the back side of the neck.

4. The stringed practice device of claim 3, wherein each of the tunings posts are configured to couple to a non-ball-end of a string.

5. The stringed practice device of claim 1, wherein the neck comprises a fret board and a plurality of frets.

6. The stringed practice device of claim 5, wherein the plurality of frets are seven frets, and the neck and the seven frets are configured to replicate a neck size, fret spacing, and fret scale of a first seven frets of an electric guitar.

7. The stringed practice device of claim 5, wherein the plurality of frets are seven frets, and the neck and the seven frets are configured to replicate a neck size, fret spacing, and fret scale of a first seven frets of an electric bass.

8. The stringed practice device of claim 5, wherein the plurality of frets are seven frets, and the neck and the seven frets are configured to replicate a neck size, fret spacing, and fret scale of a first seven frets of an classical guitar.

9. The stringed practice device of claim 5, wherein the plurality of frets are five frets, and the neck and the five frets are configured to replicate a neck size, fret spacing, and fret scale of a first five frets of an electric guitar.

10. The stringed practice device of claim 5, wherein the plurality of frets are five frets, and the neck and the five frets are configured to replicate a neck size, fret spacing, and fret scale of a first five frets of an electric bass.

11. The stringed practice device of claim 5, wherein the plurality of frets are five frets, and the neck and the five frets are configured to replicate a neck size, fret spacing, and fret scale of a first five frets of a classical guitar.

12. The stringed practice device of claim 5, wherein the plurality of frets are configured to replicate a neck size, fret spacing, and fret scale of plurality of high frets of an electric guitar.

13. The stringed practice device of claim 6, wherein the plurality of frets are configured to replicate a neck size, fret spacing, and fret scale of plurality of high frets of an electric bass.

14. The stringed practice device of claim 5, wherein the plurality of frets are configured to replicate a neck size, fret spacing, and fret scale of plurality of high frets of a classical guitar.

15. The stringed practice device of claim 5, wherein the plurality of frets are configured to replicate a neck size, fret spacing, and fret scale of plurality of high frets of a classical guitar.

* * * * *